US006167831B1

(12) United States Patent
Watt et al.

(10) Patent No.: US 6,167,831 B1
(45) Date of Patent: Jan. 2, 2001

(54) UNDERWATER VEHICLE

(75) Inventors: Andrew M. Watt, Jupiter; Allen F. Leatt, Tequesta, both of FL (US); Calum MacKinnon, Aberdeen (GB)

(73) Assignee: Coflexip S.A., Paris (FR)

( * ) Notice: Under 35 U.S.C. 154(b), the term of this patent shall be extended for 0 days.

(21) Appl. No.: 09/399,493

(22) Filed: Sep. 20, 1999

(51) Int. Cl.[7] ..... B63G 8/41
(52) U.S. Cl. ..... 114/322; 114/245
(58) Field of Search ..... 114/244–246, 313, 114/322

(56) References Cited

U.S. PATENT DOCUMENTS

| | | | | |
|---|---|---|---|---|
| 3,099,316 | | 7/1963 | Johnson . | |
| 3,702,597 | * | 11/1972 | Odum et al. | 114/322 |
| 3,918,113 | * | 11/1975 | Talkington | 114/245 |
| 4,010,619 | * | 3/1977 | Hightower et al. | 114/322 |
| 4,231,171 | * | 11/1980 | Balligand et al. | 114/313 |
| 4,252,467 | * | 2/1981 | Amrhein | 114/322 |
| 4,306,413 | * | 12/1981 | Middleton | 114/322 |
| 4,502,407 | | 3/1985 | Stevens | 114/222 |
| 4,706,119 | | 11/1987 | Shatto, Jr. et al. . | |
| 4,732,215 | | 3/1988 | Hopper . | |
| 5,042,415 | * | 8/1991 | Hoffman | 114/322 |

FOREIGN PATENT DOCUMENTS 2 210 838 6/1989 (GB) .

* cited by examiner

*Primary Examiner*—Jesus D. Sotelo
(74) *Attorney, Agent, or Firm*—Akerman Senterfitt

(57) ABSTRACT

An underwater apparatus for performing subsurface operations adapted to be operated from a remote location above the surface of a body of water is disclosed. The apparatus includes a underwater vehicle that is made up of a tether management system connected to a detachable flying craft by a tether. The tether management system controls the amount of free tether between itself and the detachable flying craft. The detachable flying craft interfaces with various underwater structures. Also disclosed are methods of transferring power and/or data between two or more underwater devices using the underwater vehicle of the invention.

17 Claims, 7 Drawing Sheets

UNDERWATER VEHICLE

CROSS-REFERENCE TO RELATED APPLICATIONS (Not Applicable)

STATEMENT REGARDING FEDERALLY SPONSORED RESEARCH OR DEVELOPMENT (Not Applicable)

FIELD OF THE INVENTION

The invention relates to the field of vehicles for servicing and operating equipment in deep water and methods for utilizing such vehicles. More particularly, the invention relates to underwater vehicles having a tether management system and a detachable flying craft for use in deep water.

BACKGROUND OF THE INVENTION

Vehicles that operate underwater are useful for performing tasks below the sea surface in such fields as deep water salvage, the underwater telecommunications industry, the offshore petroleum industry, offshore mining, and oceanographic research. (See, e.g., U.S. Pat. Nos. 3,099,316 and 4,502,407). Conventional unmanned subsurface vehicles can be broadly classified according to how they are controlled. Autonomous underwater vehicles (AUVs) are subsurface vehicles that are not physically connected to a support platform such as a land-based platform, an offshore platform, or a sea-going vessel. In comparison, remotely operated vehicle (ROVs) are those subsea vehicles that are physically connected to a support platform.

The typical physical connection between an ROV and a support platform is referred to as an "umbilical." The umbilical is usually an armored or unarmored cable containing an electrical and/or hydraulic conduit for providing power to an ROV and a data communications conduit for transmitting signals between an ROV and a support platform. An umbilical thus provides a means for remotely controlling an ROV during underwater operation.

ROVs are commonly equipped with on-board propulsion systems, navigation systems, communication systems, video systems, lights, and mechanical manipulators so that they can move to an underwater work site and perform a particular task. For example, after being lowered to a subsurface position, a remotely-located technician or pilot can utilize an ROV's on-board navigation and communications systems to "fly" the craft to a worksite. The technician or pilot can then operate the mechanical manipulators or other tools on the ROV to perform a particular job. In this manner, ROVs can used to perform relatively complex tasks including those involved in drill support, construction support, platform cleaning and inspection, subsurface cable burial and maintenance, deep water salvage, remote tool deployment, subsurface pipeline completion, subsurface pile suction, etc. Although they are quite flexible in that they can be adapted to perform a wide variety of tasks, ROVs are also fairly expensive to operate as they require a significant amount of support, including, for example, a pilot, technicians, and a surface support platform.

ROVs and other subsurface vehicles that are connected to a surface vessel by a physical linkage are subject to heave-induced damage. Heave is the up and down motion of an object produced by waves on the surface of a body of water. Underwater vehicles physically attached to a floating surface platform therefore move in accord with the surface platform.

Therefore, when an underwater vehicle is located near a fixed object such as the sea bed, a pipeline, or a wellhead, heave-induced movement can damage both the vehicle and the fixed object. To alleviate this problem, devices such as heave-induced motion compensators and tether management systems have been employed to reduce the transfer of heave to underwater vehicles.

In contrast to ROVs, while underwater, AUVs are not subject to heave-mediated damage because they are not usually physically connected to a support platform. Like ROVs, AUVs are useful for performing a variety of underwater operations. Common AUVs are essentially unmanned submarines that contain an on-board power supply, propulsion system, and a pre-programmed control system. In a typical operation, after being placed in the water from a surface platform, an AUV will carry out a pre-programmed mission, then automatically surface for recovery. In this fashion, AUVs can perform subsurface tasks without requiring constant attention from a technician. AUVs are also substantially less expensive to operate than ROVs because they do not require an umbilical connection to an attached surface support platform.

AUVs, however, have practical limitations rendering them unsuitable for certain underwater operations. For example, power in an AUV typically comes from an on-board power supply such as a battery. Because this on-board power supply has a limited capacity, tasks requiring a substantial amount of power such as cutting and drilling are not practically performed by AUVs. In addition, the amount of time that an AUV can operate underwater is limited by its on-board power supply. Thus, AUVs must surface, be recovered, and be recharged between missions-a procedure which risks damage to the AUV and mandates the expense of a recovery vessel (e.g., a boat).

Another drawback of AUVs is that, without a physical link to a surface vessel, communication between an AUV and a remote operator (e.g., a technician) is limited. For example, AUVs conventionally employ an acoustic modem for communicating with a remote operator. Because such underwater acoustic communications do not convey data as rapidly or accurately as electrical wires or fiber optics, transfer of data encoding real time video signals or real time instructions from a remote operator is not efficient given current technology. As such, AUVs are often not able to perform unanticipated tasks or jobs requiring a great deal of operator input.

Other underwater vehicles having characteristics similar to AUVs and/or ROVs are known. These vehicles also suffer drawbacks such as subjection to heave, need for expensive support, poor suitability for some applications, lack of a continuous power supply, poor communications, poor capabilities, etc. Therefore, a need exists for a device to help overcome these limitations.

SUMMARY

The present application is directed to an underwater vehicle for performing subsurface tasks, and/or for interfacing with, transferring power to, and sharing data with other underwater devices. The vehicle within the invention includes a detachable flying craft for performing an underwater operation or for servicing and operating various subsurface devices such as toolskids, ROVs, AUVs, pipeline sections (spool pieces), seabed anchors, suction anchors, oil field production packages, and other equipment such as lifting frames, etc. The underwater vehicle also includes a tether management system for deploying and retrieving a tether that connects the tether management system to the detachable flying craft.

The detachable flying craft is a highly maneuverable, remotely-operable underwater vehicle that may have a manipulator or tool attached to it for performing a particular manual job. For example, the tool may be a drill for drilling, a saw for cutting, a grasping arm for manipulating components of an underwater object, etc. The detachable flying craft may also feature a connector adapted to "latch" on to or physically engage a receptor on a subsurface device. In addition to stabilizing the interaction of the detachable flying craft and the subsurface device, the connector-receptor engagement can also be utilized to transfer power and data. In this aspect, the detachable flying craft is therefore essentially a flying power outlet and/or a flying data modem.

The tether management system of the underwater vehicle regulates the quantity of free tether between itself and the detachable flying craft. It thereby permits the underwater vehicle to switch between two different configurations: a "closed configuration" in which the tether management system physically abuts the detachable flying craft; and an "open configuration" in which the tether management system and detachable flying craft are separated by a length of tether. In the open configuration, slack in the tether allows the detachable flying craft to move independently of the tether management system. Thus, where the tether management system portion of the underwater vehicle is affixed to a subsurface device, the detachable flying craft can still move to any location within the tether's reach.

The underwater vehicle of the invention has several advantages over conventional subsurface devices such as ROVs and AUVs vehicles. For example, unlike ROVs, because the featured underwater vehicle is self-propelled, it does not require an attached umbilical nor a surface support vessel for its positioning or operation. Additionally, unlike AUVs, because the underwater vehicle of the invention can be attached to a subsurface power and/or data supply, it can perform tasks requiring more power than can be supplied by the typical on-board power supplies of conventional AUVs. Moreover, unlike AUVs, by attachment to a subsurface power and/or data supply that is connected to a remotely-located surface structure (e.g., a subsurface module connected to an offshore platform via a power and data-communicating pipe), the underwater vehicle can be manually-operated by a technician or pilot.

The flexibility of the underwater vehicle of the invention allows it be used for various other undersea operations. Among these, for example, the underwater vehicle can be used to directly perform underwater tasks using an on-board mechanical manipulator (i.e., as an underwater power tool). The vehicle can also be used as a power and data bridge, to indirectly provide power and control data from an external subsurface source to underwater tools such as cleaners, cutters, and jetters. As another example, the underwater vehicle can be utilized for subsurface battery charging of underwater devices such as AUVs and battery-powered underwater tools.

Accordingly, the invention features a self-propelled submersible vehicle for connecting to and utilizing a subsurface power supply module. This submersible vehicle includes a body, a tether management system, and a work craft. The body has an input port configured for connecting to the subsurface power supply module and for communicating power and/or data with the subsurface power supply module. The tether management system is attached to the input port by a cable configured for communicating the power and/or data with the input port. The work craft is connected to a tether connected to the tether management system. And the tether is configured for communicating the power and/or data with the work craft.

The submersible vehicle of the invention can also be self-propelled to move itself between the tether management system and a subsurface device. The vehicle may have a vehicle connector for detachably engaging the subsurface device, a power output port for transferring power to the subsurface device, and/or a data output port for transferring data between the subsurface device and the craft. In some cases, the craft has a mechanical manipulator. Such crafts can also be configured to engage a subsurface device.

The invention also features method of performing an undersea operation. This method includes the steps of: deploying a submersible vehicle, and connecting the vehicle to a subsurface power supply module. The submersible vehicle of this method can be any one of the submersible vehicles mentioned above.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In the case of conflict, the present specification, including definitions will control. In addition, the particular embodiments discussed below are illustrative only and not intended to be limiting.

BRIEF DESCRIPTION OF THE DRAWINGS

The invention is pointed out with particularity in the appended claims. The above and further advantages of this invention may be better understood by referring to the following description taken in conjunction with the accompanying drawings, in which:

DETAILED DESCRIPTION

The invention encompasses underwater vehicles for performing subsurface tasks, and/or for interfacing with, transferring power to, and sharing data with other underwater devices. The vehicles within the invention include a detachable flying craft for performing an underwater operation or for servicing and operating various subsurface devices such as toolskids, ROVs, AUVs, pipeline sections (spool pieces), seabed anchors, suction anchors, oil field production packages, and other equipment such as lifting frames, etc. The underwater vehicles also include a tether management system for deploying and retrieving a tether that connects the tether management system to the detachable flying craft. The below described preferred embodiments illustrate various adaptations of the invention. Nonetheless, from the description of these embodiments, other aspects of the invention can be readily fashioned by making slight adjustments or modifications to the components discussed below.

Figure 1A:
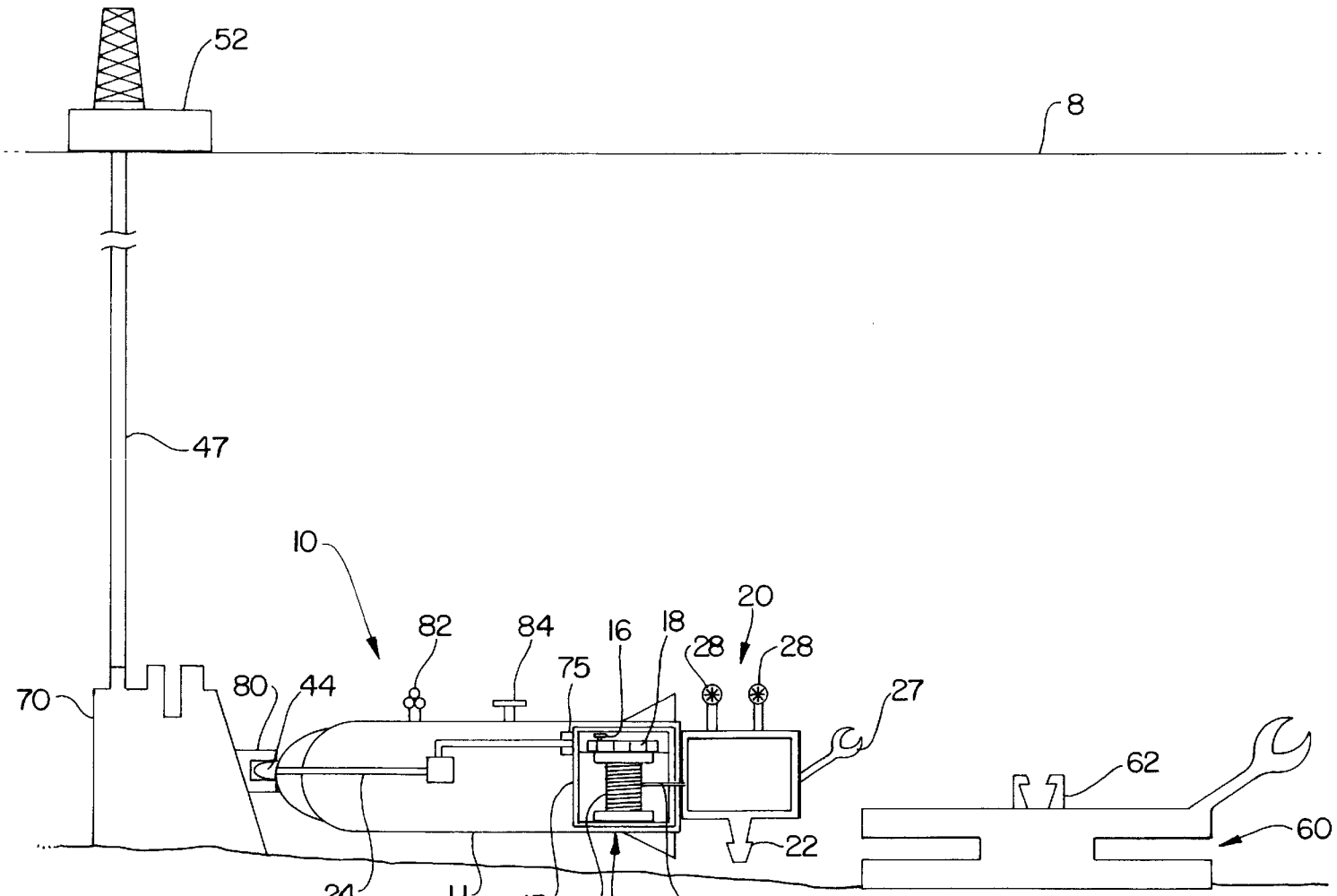
FIG. 1A is a schematic view of an underwater vehicle of the invention shown in the closed configuration.
Figure 1B:
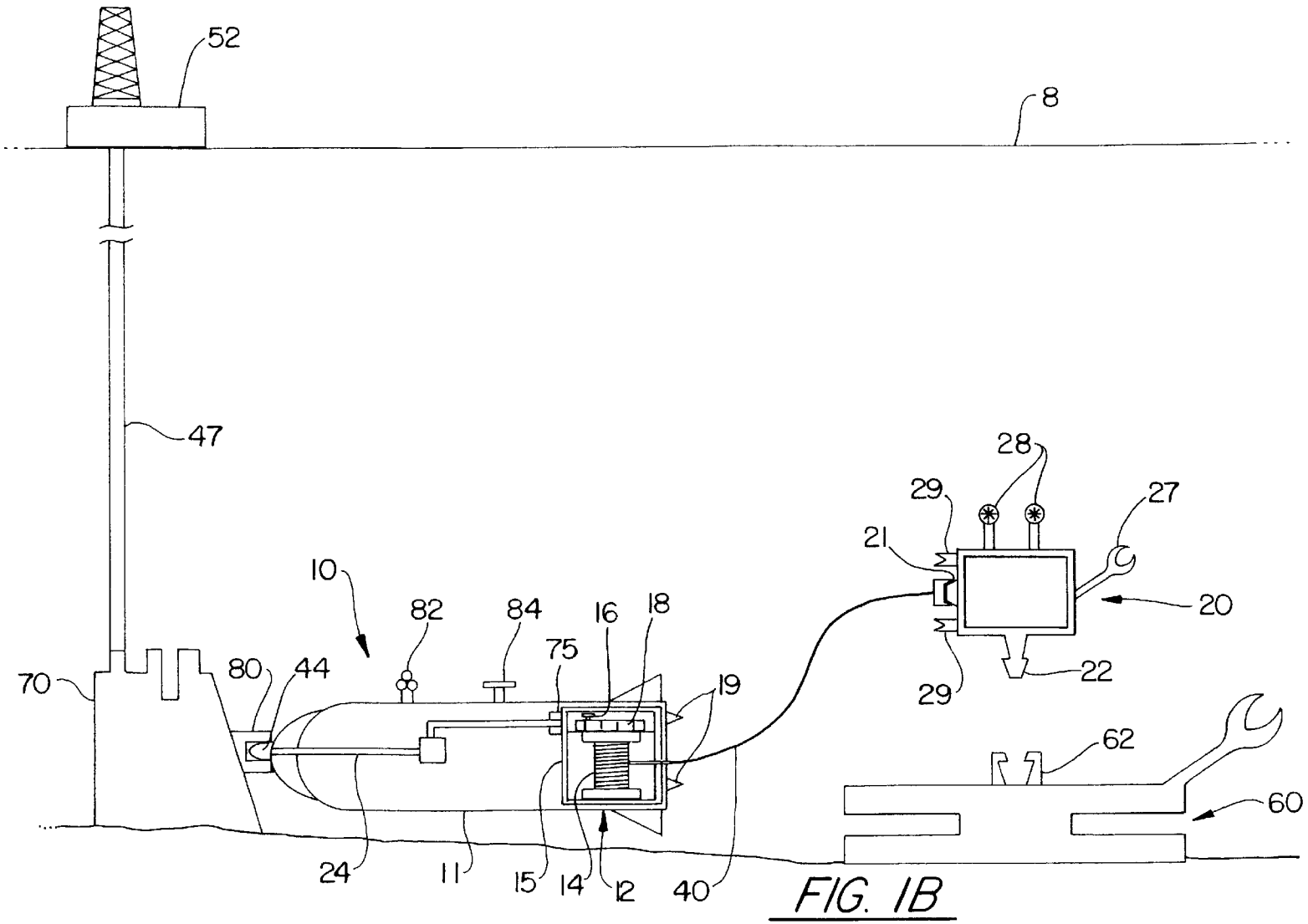
FIG. 1B is a schematic view of an underwater vehicle of the invention shown in the open configuration.

Referring now to FIGS. 1A and 1B of the drawings, the presently preferred embodiment of the invention features an underwater vehicle 10 having a body 11 to which is attached a tether management system 12 connected to a detachable flying craft 20 by a tether 40. Also shown in FIGS. 1A and 1B are a subsurface module 70 connected to a module pipe 47 which is attached to a surface platform 52 at the surface of a body of water 8. Additionally, an underwater device 60 is shown on the sea bed next to vehicle 10.

Body 11 is a shell that forms the external surface of underwater vehicle 10. It can take the form of any apparatus to which tether management system 12 can be connected. Other components of vehicle 10 can be attached or housed within body 11. For example, a nose port 44, a guidance system 82, and thrusters 84 can be attached to body 11, and a cable 24 housed within body 11. Body 11 is preferably composed of a rigid material that resists deformation under the extreme pressures encountered in the deep sea environment. For example, body 11 can be composed of steel or a reinforced plastic. Although it can take any shape suitable for movement underwater, in preferred embodiments, body 11 is torpedo-shaped to minimize drag.

In FIGS. 1A and 1B, tether management system 12 is shown integrated into the rear portion of body 11 of underwater vehicle 10. Tether management system 12 can be any device that can reel in or pay out tether 40. Tether management systems suitable for use as tether management system 12 are well known in the art and can be purchased from several sources (e.g., from Slingsby Engineering, United Kingdom; All Oceans, United Kingdom; and Perry Tritech, Inc., Jupiter, Florida). In preferred embodiments, however, tether management system 12 includes an external frame 15 which houses a spool 14, a spool control switch 16, a spool motor 18, and jumper tether 74.

Frame 15 forms the body of tether management system 12. It can be any device that can house and/or attach system 12 components such as spool 14, spool control switch 16, and spool motor 18. For example, frame 15 can take the form of a rigid shell or skeleton-like framework. In the presently preferred embodiment, frame 15 is a metal cage. A metal cage is preferred because it be easily affixed to body 11, and also provides areas for mounting other components of tether management system 12.

Spool 14 is a component of tether management system 12 that controls the length of tether 40 dispensed from system 12. It can any device that can reel in, store, and pay out tether 40. For example, spool 14 can take the form of a winch about which tether 40 can be wound and unwound. In preferred embodiments, spool 14 is a rotatable cable drum, where rotation of the drum in one direction causes tether 40 to be payed out of tether management system 12 by unreeling it from around the drum, and rotation of the drum in the other direction causes tether 40 to be taken up by tether management system 12 by reeling it up around the drum.

Spool motor 18 provides power to operate spool 14. Spool motor 18 can be any device that is suitable for providing power to spool 14 such that spool 14 can reel in or pay out tether 40 from tether management system 12. For example, spool motor 18 can be a motor that causes spool 14 to rotate clockwise or counterclockwise to reel in or pay out tether 40. In preferred embodiments, spool motor 18 is an electrically or hydraulically-driven motor.

Spool control switch 16 is a device that controls the action of spool motor 18. It can be any type of switch which allows an on-board computer of underwater vehicle 10 to control spool motor 18. In a preferred from, it can also be a remotely-operable electrical switch that can be controlled by a technician or pilot on surface platform 52 so that motor 18 can power spool 14 operation.

Tether management system 12 can also include a power and data transfer unit 75 between cable 24 and tether 40. Unit 75 can be any apparatus that can convey power and data between cable 24 and tether 40. In preferred embodiments of the invention, unit 75 takes the form of electrical, hydraulic and/or fiber optic lines connected at one end to cable 24 and at the other end to tether 40.

Cable 24 is also attached to tether management system 12. Cable 24 is shown in FIGS. 1A and 1B as a flexible rope-like device that extends from nose port 44 to tether management system 12. Although it is preferably positioned within the interior of body 11 to prevent damage caused by accidental contact with other objects, cable 24 can also be positioned along the exterior surface of body 11. Cable 24 can take the form of any device that can transfer power and/or data between nose port 44 and tether management system 12. For example, it can be a simple insulated copper wire. In preferred embodiments, however, it is a flexible waterproof cable that houses a conduit for both power (e.g., a copper electrical wire and/or a hydraulic hose) and data communication (e.g., fiber optic cables for receipt and transmission of data).

Nose port 44 is attached to one end of body 11 and connected to cable 24. Nose port 44 can be any device that can physically engage power and data connection 80 on subsurface module 70 and transfer power and/or data between cable 44 and module 70 (via connection 80). As shown in FIGS. 1A and 1B, it preferably takes the form of a male-type bullet-shaped connector protruding from the front (i.e., nose) of body 11. In this form, port 44 is adapted to engage a female-type funnel-shaped power and data connection 80.

Also attached to tether management system 12 is tether 40. It has two ends, one end being securely attached to tether management system 12, the other end being securely attached to tether fastener 21 of detachable flying craft 20. While tether 40 can be any device that can physically connect tether management system 12 and detachable flying craft 20, it preferably takes the form of a flexible, neutrally buoyant rope-like cable that permits objects attached to it to move relatively freely. In particularly preferred embodiments, tether 40 also includes a power and data communications conduit (e.g., electricity-conducting wire, hydraulic hose, and fiber optic cable) so that power and data can be transferred through it. Tethers suitable for use in the invention are known in the art and are commercially available (e.g., Perry Tritech, Inc.; Southbay; Alcatel; NSW; and JAQUES).

Attached to the terminus of tether 40 opposite tether management system 12 is detachable flying craft 20. Detachable flying craft 20 can be any self-propelled submersible vehicle. For example, detachable flying craft 20 can be a remotely-operated underwater craft designed to mate with an undersea device for the purpose of transferring power to and/or exchanging data with the undersea device. In preferred embodiments, detachable flying craft 20 includes tether fastener 21, chassis 25, connector 22, a manipulator 27, and propulsion system 28.

Chassis 25 is a rigid structure that forms the body and/or frame of craft 20. Chassis 25 can be any device to which various components of craft 20 can be attached. For example, chassis 25 can take the form of a metal skeleton. In preferred embodiments, chassis 25 is a hollow metal or plastic shell to which the various components of craft 20 are attached. In the latter form, the interior of chassis 25 can be sealed from the external environment so that components included therein can be isolated from exposure to water and pressure. In the preferred embodiment shown in FIGS. 1A and 1B, components shown affixed to or integrated with chassis 25 include tether fastener 21, connector 22, manipulator 27, propulsion system 28, and male alignment guides 19.

Tether fastener 21 connects tether 40 to detachable flying craft 20. Tether fastener 21 can be any suitable device for attaching tether 40 to detachable flying craft 20. For example, it can take the form of a mechanical connector adapted to be fastened to a mechanical receptor on the terminus of tether 40. In preferred embodiments, tether fastener 21 is the male or female end of bullet-type mechanical fastener (the terminus of tether 40 having the corresponding type of fastener). In other embodiments, tether fastener 21 can also be part of a magnetic or electromagnetic connection system. For embodiments within the invention that require a power and/or data conduit between tether 40 and detachable flying craft 20, tether fastener 21 preferably includes a tether port for conveying power and/or data between tether 40 and detachable flying craft 20 (e.g., by means of integrated fiber optic and electrical or hydraulic connectors).

Mounted on or integrated with chassis 25 is connector 22, a structure adapted for detachably connecting receptor 62 of subsurface device 60 (an underwater device for performing a task; e.g., a toolskid) so that detachable flying craft 20 can be securely but reversibly attached to device 60. Correspondingly, receptor 62 is a structure on subsurface device 60 that is detachably connectable to connector 22. Although, in preferred embodiments, connector 22 and receptor 62 usually form a mechanical coupling, they may also connect one another through any other suitable means known in the art (e.g., magnetic or electromagnetic). In a particularly preferred embodiment connector 22 is a bullet-shaped male-type connector. This type of connector is designed to mechanically mate with a funnel-shaped receptacle such as receptor 62. The large diameter opening of the funnel-shaped receptor 62 facilitates alignment of a bullet-shaped connector 22 during the mating process. That is, in this embodiment, if connector 22 was slightly out of alignment with receptor 62 as detachable flying craft 20 approached subsurface device 60 for mating, the funnel of receptor 62 would automatically align the bullet-shaped portion of connector 22 so that craft 20's motion towards receptor 62 would automatically center connector 22 for proper engagement.

Connector 22 and receptor 62 can also take other forms so long as they are detachably connectable to each other. For example, connector 22 can take the form of a plurality of prongs arranged in an irregular pattern when receptor 62 takes the form of a plurality of sockets arranged in the same irregular pattern so that connector 22 can connect with receptor 22 in one orientation only. As another example, connector 22 can be a funnel-shaped female type receptacle where receptor 62 is a bullet-shaped male type connector. In addition to providing a mechanical coupling, in preferred embodiments, the interaction of connector 22 and receptor 62 is utilized to transfer power and data between detachable flying craft 20 and subsurface device 60. (See below).

Manipulator 27 is attached to chassis 25. In FIGS. 1A and 1B, manipulator 27 is shown as a mechanical arm for grasping subsurface objects. While it can take this form, manipulator 27 is any device that can interface with an underwater object (e.g., subsurface device 60). Thus, it can be a mechanical tool for performing a general operation (e.g., cutting) or a specific task (e.g., switching a particular valve). Manipulator 27 can also be a power and/or data port for transferring power and/or data to a underwater object. For example, manipulator 27 can be designed to mate with and to provide power to operate a toolskid.

Also attached to chassis 25 is propulsion system 28. Propulsion system 28 can be any force-producing apparatus that causes undersea movement of detachable flying craft 20 (i.e., "flying" of craft 20). Preferred devices for use as propulsion system 28 are electrically or hydraulically-powered thrusters. Such devices are widely available from commercial suppliers (e.g., Hydrovision Ltd., Aberdeen, Scotland; Innerspace, California; and others).

Figure 2:
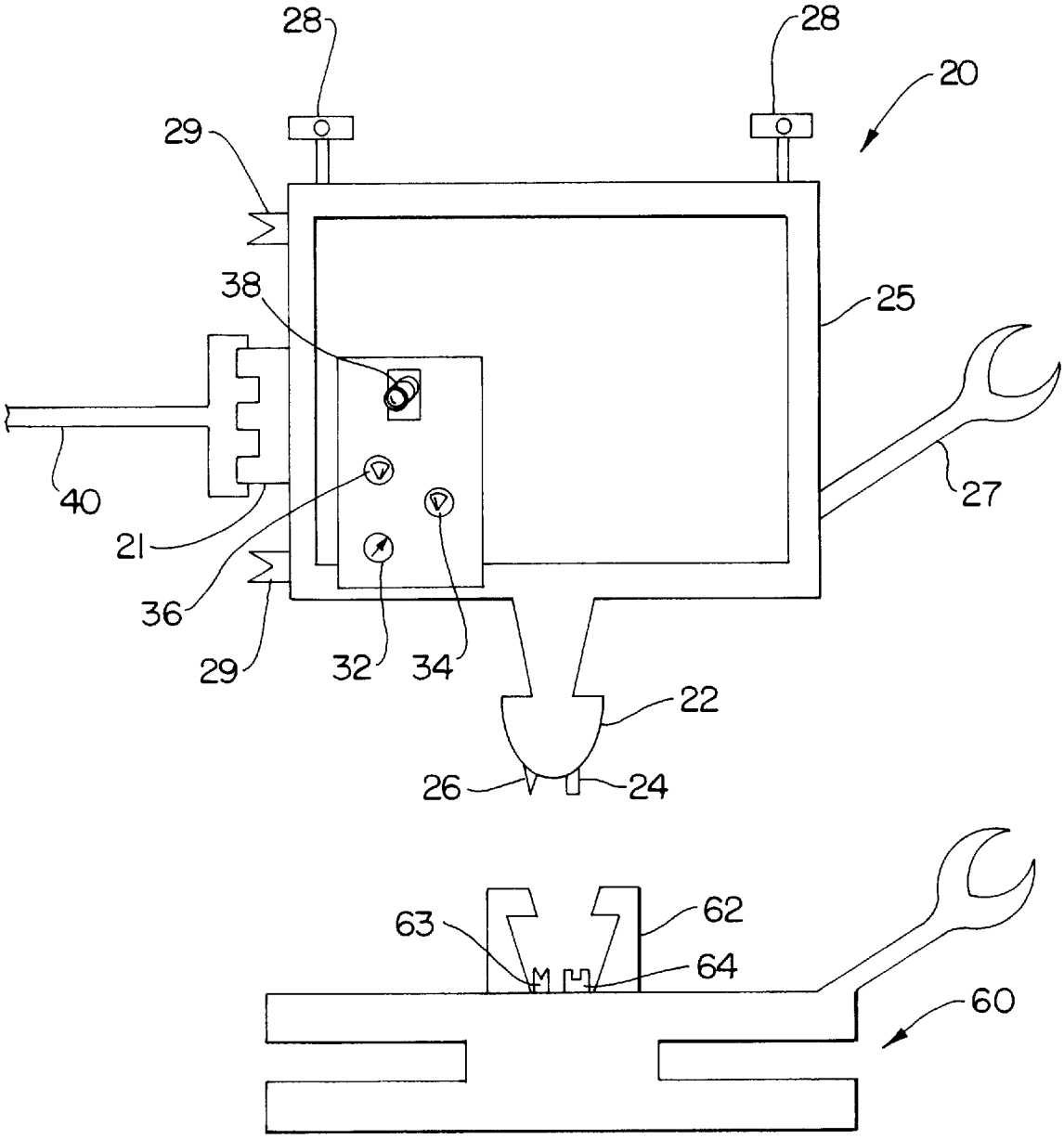
FIG. 2 is a schematic view of the detachable flying craft of the invention shown with a subsurface device.

Referring now to FIG. 2, in preferred embodiments, detachable flying craft 20 further includes a connector port that may include an output port 24 and/or a communications port 26; and position control system 30 which may include compass 32, depth indicator 34, velocity indicator 36, and/or video camera 38.

Power output port 24 can be any device that mediates the underwater transfer of power from detachable flying craft 20 to another underwater apparatus such as subsurface device 60. In preferred embodiments, port 24 physically engages power inlet 64 on subsurface device 60 such that power exits detachable flying-craft 20 from port 24 and enters device 60 through power inlet 64. Preferably, the power conveyed from power output port 24 to power inlet 64 is electrical current or hydraulic power (derived, e.g., from surface support vehicle 50) to subsurface device 60). In particularly preferred embodiments, power output port 24 and power inlet 64 form a "wet-mate" -type connector (i.e., an electrical, hydraulic, and/or optical connector designed for mating and demating underwater). In the embodiment shown in FIG. 2, port 24 is integrated into connector 22 and power inlet 64 is integrated with receptor 62. In other embodiments, however, port 24 is not integrated with connector 22 but attached at another location on detachable flying craft 20, and inlet 64 is located on device 60 such that it can engage port 26 when craft 20 and device 60 connect.

The components of detachable flying craft 20 can function together as a power transmitter for conveying power from tether 40 (e.g., supplied from module 70 through connection 80, cable 24, and tether management system 12) to an underwater apparatus such as subsurface device 60. For example, power can enter craft 20 from tether 40 through tether fastener 21. This power can then be conveyed from fastener 21 through a power conducting apparatus such as an electricity-conducting wire or a hydraulic hose attached to or housed within chassis 25 into power output port 24. Power output port 24 can then transfer the power to the underwater apparatus as described above. In preferred embodiments of the detachable flying craft of the invention, the power transmitter has the capacity to transfer more than about 50% (e.g., approximately 50%, 55%, 60%, 65%, 70%, 75%, 80%, 85%, 90%, 95%, 100%) of the power provided to it from an external power source such as subsurface module 70 (i.e., via connection 80, cable 24 and tether 40) to subsurface device 60. Power not conveyed to subsurface device 60 from the external power source can be used to operate various components on detachable flying craft 20 (e.g., propulsion system 28 and position control system 30). As one example, of 100 bhp of force transferred to craft 20, 20 bhp is used by detachable flying craft 20, and 80 bhp used by subsurface device 60.

Communications port 26 is a device that physically engages communications acceptor 63 on subsurface device 60. Port 26 and acceptor 63 mediate the transfer of data between detachable flying craft 20 and device 60. For example, in the preferred configuration shown in FIG.2, communications port 26 is a fiber optic cable connector integrated into connector 22, and acceptor 63 is another fiber optic connector integrated with receptor 62 in on device 60. The port 26-acceptor 63 connection can also be an electrical connection (e.g., telephone wire) or other type of connection (e.g., magnetic or acoustic). In particularly preferred embodiments, the communications port 26-communications acceptor 63 connection and the power output port 24-power inlet 64 connection are integrated into one "wet-mate"-type connector. In other embodiments, communications port 26 is not integrated with connector 22 but attached at another location on detachable flying craft 20, and acceptor 63 is located on device 60 such that it can engage port 26 when craft 20 and device 60 connect. Communications port 26 is preferably a two-way communications port that can mediate the transfer of data both from detachable flying craft 20 to device 60 and from device 60 to craft 20.

Communications port 26 and acceptor 63 can be used to transfer information (e.g., video output, depth, current speed, location information, etc.) from subsurface device 60 to a remotely-located operator (e.g, on surface platform 52) via module pipe 47, module 70, and underwater vehicle 10. Similarly, port 26 and acceptor 63 can be used to transfer information (e.g., mission instructions, data for controlling the location and movement of subsurface device 60, data for controlling mechanical arms and like manipulators on subsurface device 60, etc.) between a remote location (e.g., from surface platform 52) and subsurface device 60.

Position control system 30 is any system or compilation of components that controls underwater movement of detachable flying craft 20, and/or provides telemetry data from craft 20 to a remotely-located operator. Such telemetry data can be any data that indicates the location and/or movement of detachable flying craft 20 (e.g., depth, longitude, latitude, depth, speed, direction), and any related data such as sonar information, pattern recognition information, video output, temperature, current direction and speed, etc. Thus, position control system 30 can include such components as sonar systems, bathymetry devices, thermometers, current sensors, compass 32, depth indicator 34, velocity indicator 36, video camera 38, etc. These components may be any of those used in conventional underwater vehicles or may specifically designed for use with underwater vehicle 10. Suitable such components are available from several commercial sources.

The components of position control system 30 for controlling movement of detachable flying craft 20 are preferably those that control propulsion system 28 so that craft 20 can be directed to move eastward, westward, northward, southward, up, down, etc. These can, for example, take the form of remotely-operated servos for controlling the direction of thrust produced by propulsion system 28. Other components for controlling movement of detachable flying craft 20 may include buoyancy compensators for controlling the underwater depth of detachable flying craft 20 and heave compensators for reducing wave-induced motion of detachable flying craft 20. A remotely-positioned operator can receive output signals (e.g., telemetry data) and send instruction signals (e.g., data to control propulsion system 28) to position control system 30 through the data communication conduit included within cable 24, nose port 44, module 70, and module pipe 47 via the data communications conduits within tether management system 12 and tether 40.

One or more of the components comprising position control system 30 can be used as a local guidance system for docking detachable flying craft 20 to subsurface device 60. For example, the local guidance system could provide an on-board computer on vehicle 10 or a remotely-controlled pilot of craft 20 with the aforementioned telemetry data and a video image of receptor 62 on subsurface device 60 such that the computer or pilot could precisely control the movement of craft 20 into the docked position with subsurface device 60 using the components of system 30 that control movement of craft 20. As another example, for computer-controlled docking, the local guidance system could use data such as pattern recognition data to align craft 20 with subsurface device 60 and the components of system 30 that control movement of craft 20 to automatically maneuver craft 20 into the docked position with subsurface device 60.

As shown in FIGS. 1A and 1B, underwater vehicle 10 can be configured in an open position or in a closed configuration. In FIG. 1A, underwater vehicle 10 is shown in the open position where tether management system 12 is separated from detachable flying craft 20 and tether 40 is slack. In this position, to the extent of slack in tether 40, tether management system 12 and detachable flying craft 20 are independently moveable from each other. In comparison, in FIG. 1B, underwater vehicle 10 is shown in the closed position. In this configuration, tether management system 12 physically abuts detachable flying craft 20 and tether 40 is tautly withdrawn into tether management system 12. In order to prevent movement of tether management system 12 and detachable flying craft 20 when underwater vehicle 10 is in the closed configuration,male alignment guides 19 can be affixed to tether management system 12 so that they interlock the female alignment guides 29 affixed to detachable flying craft 20. Male alignment guides 19 can be any type of connector that securely engages female alignment guides 29 such that movement of system 12 is restricted with respect to craft 20, and vice versa.

Several other components known in the art of underwater vehicles can be included on underwater vehicle 10. One skilled in this art, could select these components based on the particular intended application of underwater vehicle 10. For example, an acoustic modem could be included within underwater vehicle 10 to provide an additional communications link among, for example, underwater vehicle 10, attached subsurface device 60, and surface platform 52.

Methods of using underwater vehicle 10 are also within the invention. For example, as shown in FIGS. 3A–3F, underwater vehicle 10 can be used for performing an operation at the seabed using manipulator 27. In preferred embodiments this method includes the steps of: deploying underwater vehicle 10 to the bottom of body of water 8 (i.e., the seabed), connecting vehicle 10 to subsurface module 70, transferring power and/or data between vehicle 10 and module 70; placing vehicle 10 in the open configuration by detaching detachable flying craft 20 from tether management system 12; positioning flying craft 20 at a worksite, and utilizing flying craft 20 to perform the operation. For this method, subsurface module 70 can be any subsurface apparatus that can provide power and/or data to another subsurface device (e.g., a manifold of a well head). For example, power and data can be transferred between subsurface module 70 and surface platform 52 via module pipe 47.

Figure 3A:
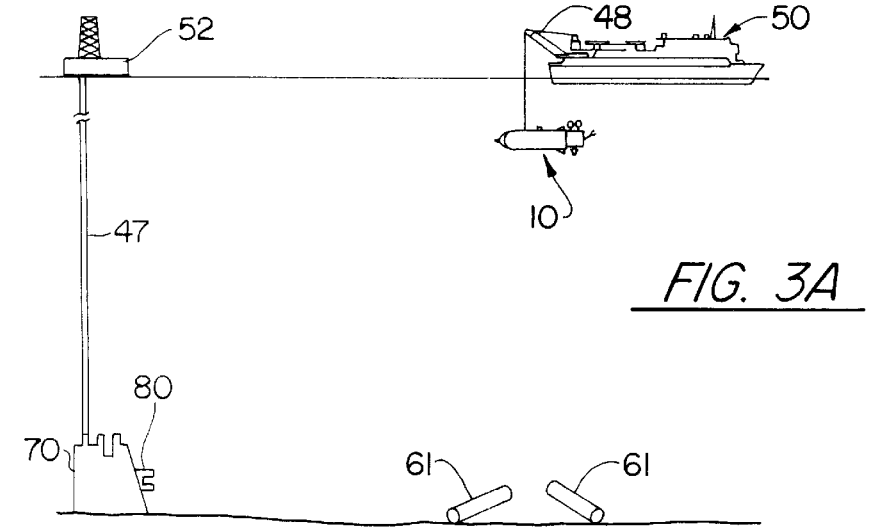
FIGS. 3A–F are schematic views of an underwater operation performed by an underwater vehicle of the invention.

One example of this method is illustrated in FIGS. 3A-3F, where underwater vehicle 10 is used to connect two pipe sections 61. As shown in FIG. 3A underwater vehicle 10 is deployed from vessel 50. Vehicle 10 can be deployed from vessel 50 (or an surface platform) by any method known in the art. For example, underwater vehicle 10 can be lowered into body of water 8 using a winch. Preferably, to prevent damage, underwater vehicle 10 is gently lowered from vessel 50 using launching and recovery device 48 (e.g., a crane).

Figure 3B:
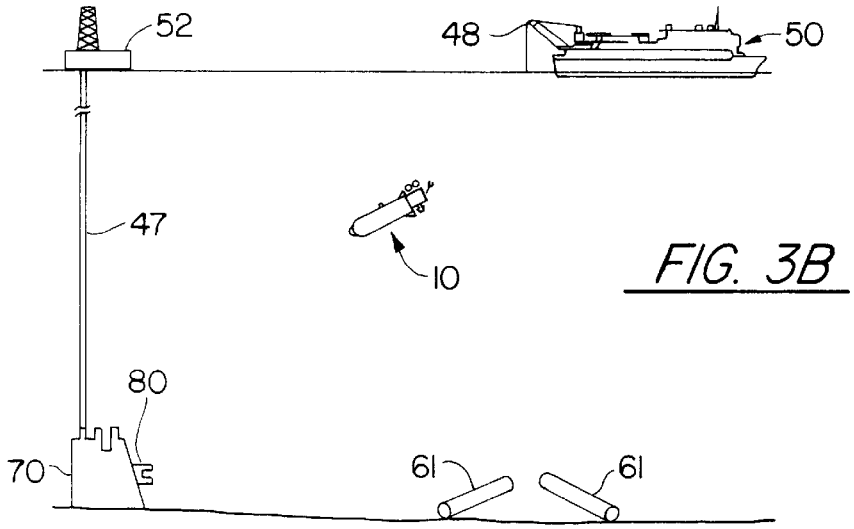
Figure 3C:
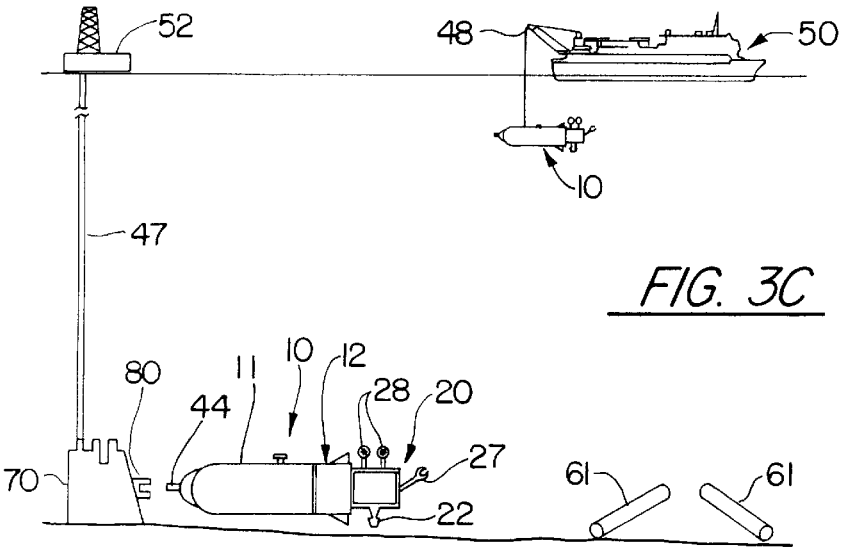
Figure 3D:
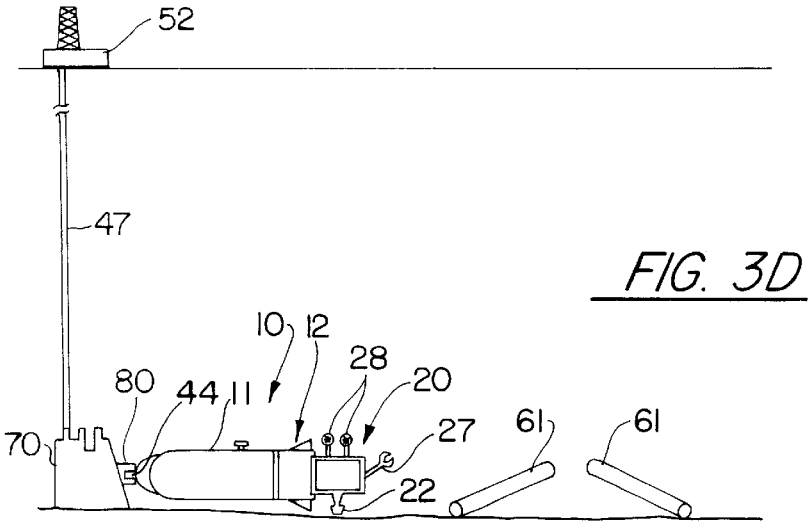

In FIG. 3B, underwater vehicle 10 is shown diving towards the seabed to a location near subsurface module 70. An on-board power supply (e.g., a battery), guidance system 82, and thrusters 84 can be used to move vehicle 10, for example, according to a set of pre-programmed instructions stored in an on-board computer system for operating vehicle 10. In FIG. 3C, underwater vehicle 10 is shown hovering at a location just above the seabed adjacent to subsurface module 70. As shown in FIG. 3D, vehicle 10 is moved towards module 70 so that nose port 44 engages power and data connection 80 (a power and data output socket on module 70), thereby establishing a power and data connection between module 70 and underwater vehicle 10. The on-board power supply on vehicle 10 can then be powered down, so that vehicle 10 and its components obtain power only from module 70. The on-board power supply of vehicle 10 can also be recharged during this process using the energy supplied from module 70.

Figure 3E:
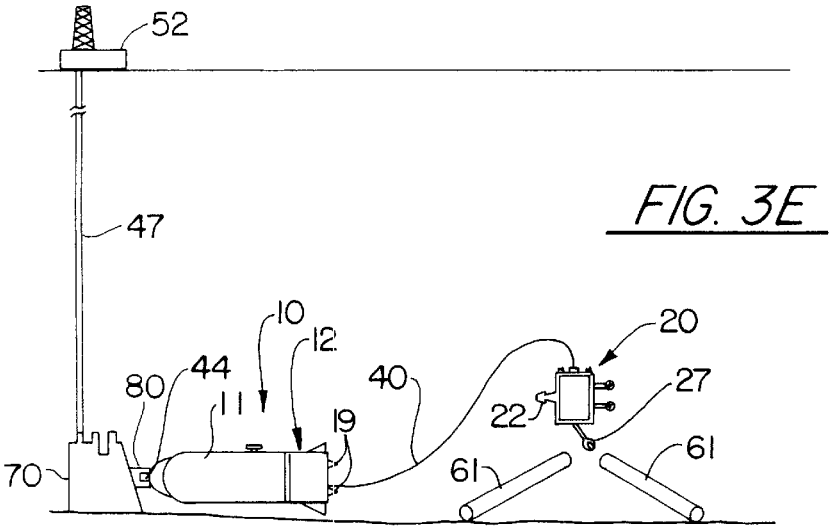
Figure 3F:
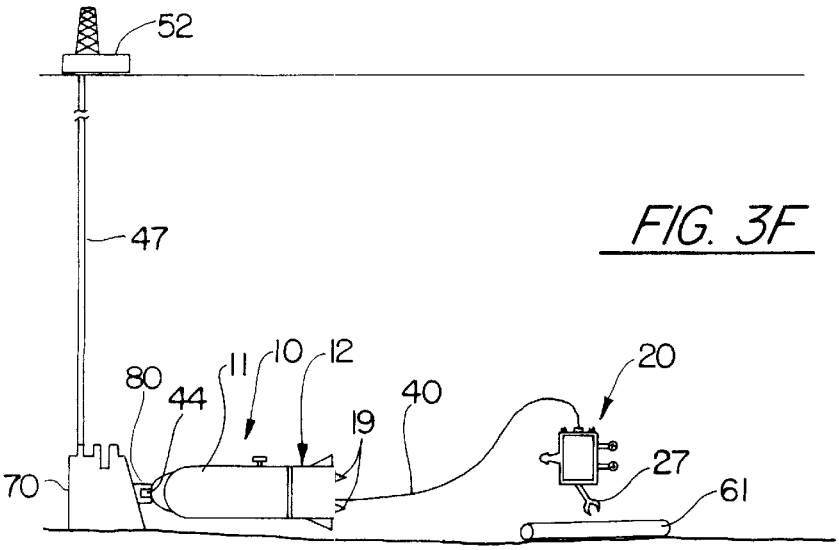

As shown in FIG. 3E, detachable flying craft 20 then detaches from tether management system 12 and flies (e.g., using power derived from module 70 to operate propulsion system 28) to the worksite, i.e., where the pipe sections are located. As shown in FIG. 3F, detachable flying craft 20 then performs the operation (i.e., attaches the two pipe sections 61 using manipulator 27). Power from module 70 is used to operate the components on detachable flying craft 20 used to attach the two pipe sections 61. For example, where module 70 is connected to a surface structure such as surface platform 52 (see FIG. 1B for example), the power and data bridge formed by platform 52, pipe 47, module 70, connection 80, and underwater vehicle 10 allows detachable flying craft 20 to be remotely operated by a pilot located on the surface platform 52.

As another exemplary method, as illustrated in FIGS. 4A–F, underwater vehicle 10 can be used for conveying power and/or data between subsurface module 70 and subsurface device 60 (e.g., a toolskid). In preferred embodiments this method includes the steps of: deploying underwater vehicle 10 to a subsurface location of body of water 8 (e.g., the seabed), connecting vehicle 10 to subsurface module 70, placing vehicle 10 in the open configuration by detaching detachable flying craft 20 from tether management system 12; connecting vehicle 10 to subsurface module 70; transferring power and/or data from module 70 to vehicle 10, placing vehicle 10 in the open configuration by detaching detachable flying craft 20 from tether management system 12; physically attaching flying craft 20 to subsurface device 60, and transferring power and/or data between flying craft 20 and device 60 so that device 60 can operate (i.e., perform a task it was designed for).

One example of this method is illustrated in FIGS. 4A–4F. As described above for FIGS. 3A–3D and as shown in FIGS. 4A–4D, underwater vehicle 10 is deployed from vessel 50, moved towards the seabed to a location near subsurface module 70, and then positioned just adjacent to subsurface module 70 so that additional forward movement of vehicle 10 towards module 70 causes nose part 44 to engage power and data connection 80 of module 70. This engagement allows power and data to flow between module 70 and underwater vehicle 10. The on-board power supply on vehicle 10 can then be powered down, so that vehicle 10 and its components obtain power only from module 70.

Figure 4A:
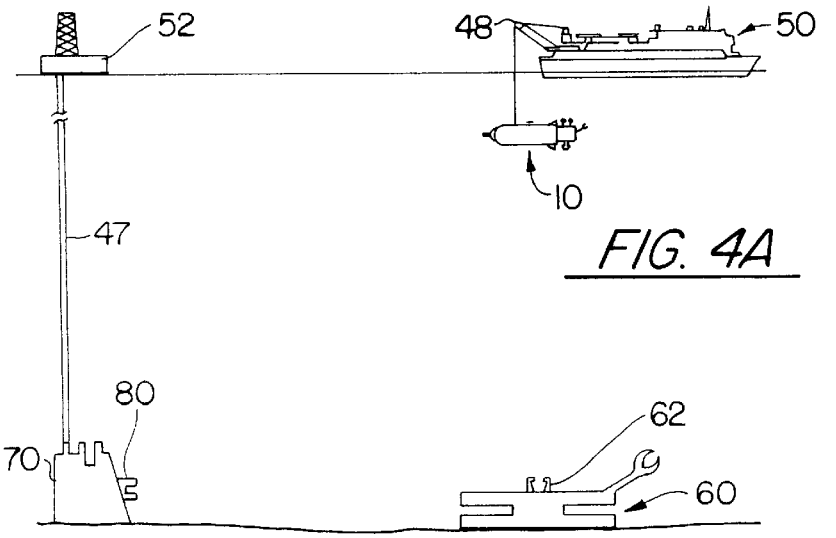
FIGS. 4A–F are schematic views showing the use of an underwater vehicle of the invention for providing power to an undersea device.
Figure 4B:
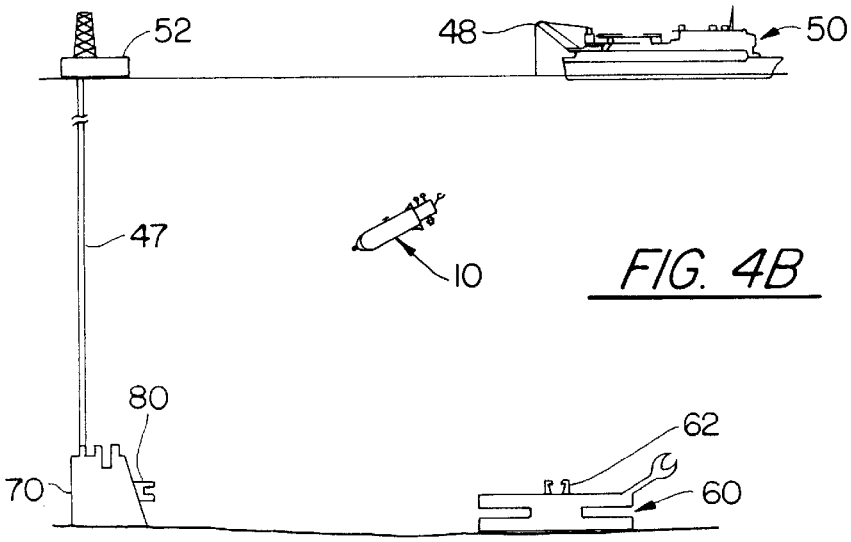
Figure 4C:
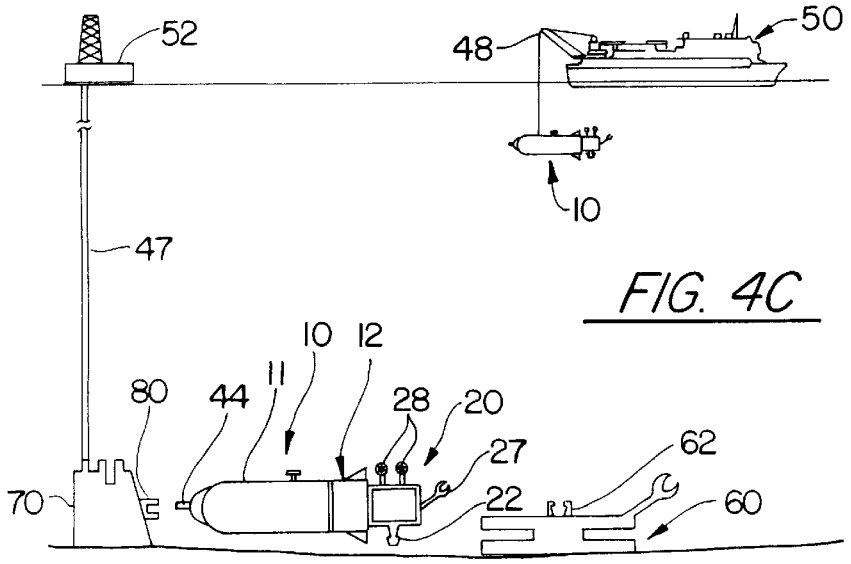
Figure 4D:
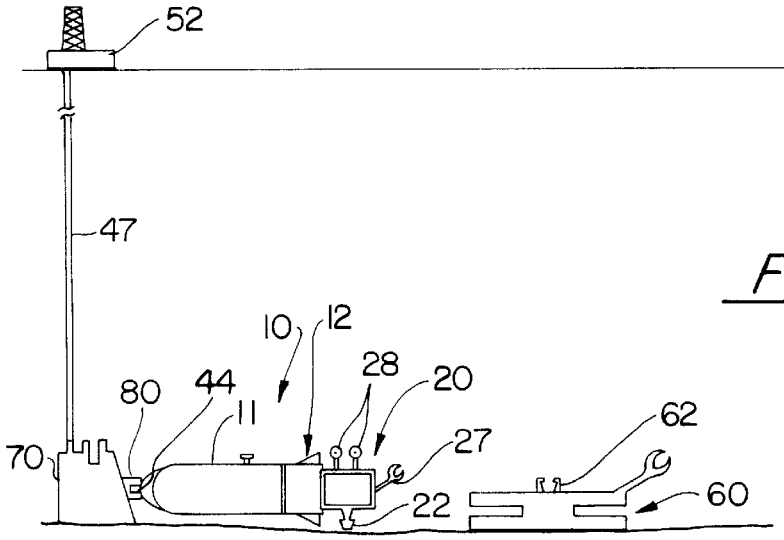
Figure 4E:
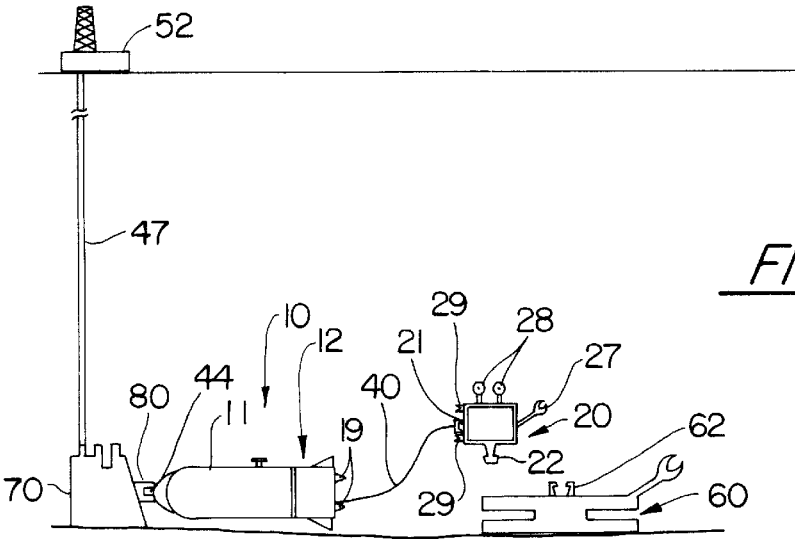
Figure 4F:
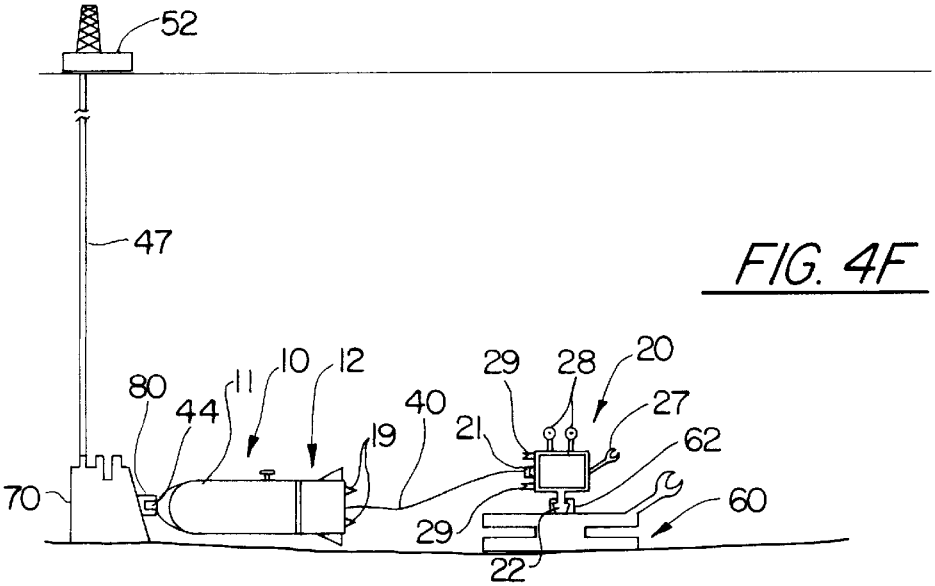

As shown in FIG. 4E, detachable flying craft 20 then detaches from tether management system 12 and flies (e.g., using power derived from module 70 to operate propulsion system 28) to a location near subsurface device 60. After proper alignment of detachable flying craft 20 with subsurface device 60, craft 20 is moved (e.g., using propulsion system 28) a short distance toward device 60 so that connector 22 securely engages (i.e., docks) receptor 62. FIG. 4F shows detachable flying craft 20 physically engaging (i.e., docking) subsurface device 60. In this manner, power and data can be transferred between module 70 and device 60. For example, where module 70 is connected to a surface structure such as surface platform 52 (see FIG. 1A for example), the power and data bridge by platform 52, pipe 47, module 70, connection 80, and underwater vehicle 10 allows subsurface device 60 to be remotely operated by a pilot located on the surface platform 52.

In addition to the foregoing, several other variations on the use of underwater vehicle 10 are within the invention. For example, two or more underwater vehicles 10 can be lowered to subsurface locations to link several underwater devices 60 and modules 70 to create a network of power and data connections for operating the underwater devices 60. Myriad variations on the foregoing methods can be made for interfacing subsurface devices. For example, rather than using a fixed subsurface power supply (e.g., module 70), power can be supplied for these methods from an underwater vehicle such as a submarine.

From the foregoing, it can be appreciated that the underwater vehicle of the invention facilitates many undersea operations.

While the above specification contains many specifics, these should not be construed as limitations on the scope of the invention, but rather as examples of preferred embodiments thereof. Many other variations are possible. For example, a manned underwater vehicle and undersea vehicles having a underwater vehicle incorporated therein are included within the invention. Accordingly, the scope of the invention should be determined not by the embodiments illustrated, but by the appended claims and their legal equivalents.

What is claimed is:

1. A self-propelled submersible vehicle for connecting to and utilizing a subsurface power supply module, said submersible vehicle comprising:

a body having an input port, said input port configured for connecting to said subsurface power supply module and for communicating at least one of power and data with said subsurface power supply module;

a tether management system attached to said input port by a cable configured for communicating said at least one of power and data with said input port; and a work craft for performing an underwater operation, said craft being connected to a tether connected to said tether management system, said tether being configured for communicating said at least one of power and data with said work craft.

2. The submersible vehicle of claim 1, wherein said craft is self-propelled to move between said tether management system and a subsurface device.

3. The submersible vehicle of claim 2, wherein said craft has a vehicle connector for detachably engaging said subsurface device.

4. The submersible vehicle of claim 3, wherein said craft further includes a power output port for transferring power to said subsurface device.

5. The submersible vehicle of claim 3, wherein said craft further includes a data output port for transferring data between said subsurface device and said craft.

6. The submersible vehicle of claim 4, wherein said craft further includes a data output port for transferring data between said subsurface device and said craft.

7. The submersible vehicle of claim 1, wherein said craft includes a mechanical manipulator.

8. The submersible vehicle of claim 7, wherein said craft is configured to engage a subsurface device.

9. A method of performing an undersea operation, said method comprising the steps of:

flying an unmanned self-propelled submersible vehicle to a subsurface location;

in response to a control command, establishing at least one of a data and power connection to a subsurface module; and flying an underwater craft connected to said vehicle by a tether, said underwater craft performing said undersea operation remote from said subsurface location.

10. The method of claim 9, wherein said craft is self-propelled to move between said vehicle and a subsurface device.

11. The method of claim 10, wherein said craft is operated using power supplied by said subsurface module.

12. The method of claim 11, further comprising the step of attaching a connector on said craft to said subsurface device.

13. The method of claim 12, further comprising the step of transferring power from said craft to said subsurface device.

14. The method of claim 10, wherein data is transferred between said craft and said subsurface module.

15. The method of claim 14, further comprising the step of transferring said data between said subsurface device and said craft.

16. The method of claim 12, wherein data is transferred between said craft and said subsurface module.

17. The method of claim 16, further comprising the step of transferring said data between said subsurface device and said craft.

* * * * *